United States Patent [19]

Chessin et al.

[11] 4,450,050

[45] May 22, 1984

[54] PROCESS FOR BONDING HIGH EFFICIENCY CHROMIUM ELECTRODEPOSITS

[75] Inventors: Hyman Chessin, Brick Township, Ocean County; Edmund C. Knill, Tinton Falls, both of N.J.

[73] Assignee: M&T Chemicals Inc., Woodbridge, N.J.

[21] Appl. No.: 463,465

[22] Filed: Feb. 3, 1983

[51] Int. Cl.[3] ..... B01D 15/00; C25D 3/04

[52] U.S. Cl. ..... 204/41; 204/34; 204/35 R; 204/51

[58] Field of Search ..... 204/41, 34, 35 R

[56] References Cited

U.S. PATENT DOCUMENTS

| | | | |
|---|---|---|---|
| 3,806,429 | 4/1974 | Clauss | 204/41 |
| 4,188,459 | 2/1980 | Hyner | 204/41 |
| 4,234,396 | 11/1980 | Parakh | 204/51 |
| 4,366,034 | 12/1982 | Ricks | 204/51 |

*Primary Examiner*—John F. Niebling

*Attorney, Agent, or Firm*—Stanley A. Marcus; Franklyn Schoenberg; Sheldon H. Parker

[57] ABSTRACT

An adherent chromium deposit is obtained on a substrate by means of a process which involves applying an adherent iron containing deposit to the substrate, anodic treating the iron containing deposit and depositing chromium on the treated, iron containing deposit from a bath containing a halogen releasing compound selected from the group consisting of iodine releasing compounds, bromine releasing compounds and mixtures thereof. Supplemental catalysts such as sulfates, simple and complex fluorides, borates, carboxylates, chlorides, chlorates and perchlorates can also be present. The process can further include the step of activating the substrate in an acid bath or an iron or an iron alloy plating bath prior to iron plating from an iron salt containing bath.

11 Claims, No Drawings

PROCESS FOR BONDING HIGH EFFICIENCY CHROMIUM ELECTRODEPOSITS

BACKGROUND OF THE INVENTION

Cross-Reference to Related Patent Applications

The instant invention relates to an improvement over the process which is fully described in copending U.S. patent application Ser. No. 06/295,430, filed Aug. 24, 1981, now abandoned the subject matter of which is incorporated herein by reference.

Technical Field

This application relates to the electrodeposition of bright chromium on basis metals or substrates from hexavalent chromium plating baths at high current efficiencies and with high adhesion quality.

Description of the Prior Art

The use of high efficiency chromium plating processes has been hampered by the inability to obtain adequate coating adhesion to certain basis metals.

Chromium plating baths containing halides have exhibited adhesion problems. Such baths are of the types disclosed in Mitsui, J7B-33941 (Sept., 1978); Dillenberg, U.S. Pat. No. 4,093,522; Perakh et al., U.S. Pat. No. 4,234,396; and copending U.S. patent application Ser. No. 06/295,430, filed Aug. 24, 1981 now abandoned.

The problem has been attributed to the presence of a halide which may interfere at the initiation of deposition.

In order to obtain an adequate bond as measured by ASTM B 571-79, with typical chromium plating solutions, such as those using a solution of chromic acid and catalysts such as sulfate, or sulfate in combination with various fluorides, the usual technique is to reverse or anodically etch a ferrous workpiece in the plating solution or in a separate chromic acid containing solution at a predetermined current density for a predetermined time.

A table which lists the time lengths for such an etching process is found in "Metal Finishing" 80 (5) 65-8 (1982) by C. H. Peger. The use of certain sulfuric acid and hydrofluoric acid etches for specific stainless steels is also suggested in the publication.

Anodic chromic acid treatments for 400 stainless steel alloys and for low and high carbon steels is disclosed in "48th Metal Finishing Guidebook-Directory" 78, 188–202 (1980) by A. Logozzo. Also recommended are cathodic treatments in sulfuric-fluoride solutions for 300 stainless, for nickel alloys and for cast iron.

A further alternative which is found in the prior art is the use of a Woods nickel strike for certain special nickel and cobalt-based alloys. (Boeing Aircraft) BAC5709-5.2j (l).

The use of a ferric chloride-hydrochloric acid solution as a clearing agent for the smut produced by anodic sulfuric etches is disclosed at page 137 of "Hard Chromium Plating" Robert Draper Ltd., Teddington, 1964 by J. D. Greenwood.

It has been found that when these procedures are employed with the halide containing chromium plating baths, most of the ferrous metal substrates are not adequately plated in that the chromium deposits from these baths have inadequate adhesion.

It can be speculated that the reducing conditions at the cathode at the initiation of deposition cause the halide ion to be reduced to a form which interferes with the molecular bonding of the chromium to the substrate. In any event the use of high efficiency chromium plating is limited by the problem of inadequate adhesion.

SUMMARY OF THE INVENTION

It has now been found that the problems encountered with the prior art systems can be overcome through the use of a process in which an iron containing electrodeposit is bonded to the substrate metal before the chromium is adherently plated onto the treated base.

In accordance with the present invention, an adherent chromium deposit is obtained on a metal substrate by means of a process which comprises the steps of subjecting the substrate to an adherent iron containing deposit, followed by a chromic acid anodic treatment and depositing chromium on the treated, iron containing deposit from a bath containing a halogen releasing compound selected from the group consisting of iodine releasing compounds, bromine releasing compounds and mixtures thereof. Supplemental catalysts such as sulfates, simple and complex fluorides, borates, carboxylates, chlorides, chlorates and perchlorates can also be present. The process can further include the step of activating the substrate metal in an acid bath or an iron or an iron alloy plating bath prior to iron plating from an iron salt containing bath.

DESCRIPTION OF THE INVENTION INCLUDING THE BEST MODE

The electrolytic coating process can best be understood by reference to U.S. Pat. Nos. 4,093,522 and 4,234,396 and copending U.S. patent application Ser. No. 06/295,430 filed Aug. 24, 1981 wherein the process steps and electrolytic bath formulations are fully described.

In the following examples and control experiments, rods 9.5 mm in diameter (⅜ inch) were held in a holder which allowed various lengths to be extended so that the treatment area can be changed as required. The usual test mandrels are steel drill rod. A thermoregulator and quartz heater were employed in order to obtain accurate heating and temperature control. In the case of chromium plating solutions the anodes are lead alloys. Chromium acid etch solutions can use stainless steel while iron plating solutions can use iron or steel counter electrodes.

In the grind adhesion tests the classification of inadequate was used to include very poor bonds in which the chromium peeled during plating or poor bonds in which there was extensive chipping of chromium from the basis metal.

The drill rod test samples were of several types. The F steel rod exhibited adequate adhesion when a chromic acid containing etching solution was used in accordance with the present invention, whereas the VP steel rod exhibited only very poor adhesion when etch alone was used. Adequate adhesion was attained only when the etching was used in combination with the iron electrodeposit pretreating step.

EXAMPLE 1

A metal substrate was plated with iron using a bath containing 200 g/l Copperas, 30 g/l boric acid, 10 ml/l sulfuric acid and 20 g/l of 48% fluoboric acid.

The metal substrate was prepared using a sandblast treatment followed by an Ajax brand scouring powder scrub, a water rinse, an alkaline dip, a water rinse and drying.

Prior to the iron plating, the 4340 steel substrate was etched in cold sulfuric acid at 2 asi for one minute.

The iron plating was carried out at 2 asi for one minute and 0.5 asi for 10 minutes at 57 degrees C., followed by a water rinse.

An anodic treatment in a 400 g/l chromic acid bath was carried out at 60° C. and 4 asi for 2 minutes.

The chromium plating step employed a 400 g/l chromic acid, 16 g/l bromate and 64 g/l acetic acid bath.

An adequate bond was attained.

EXAMPLE 2

The procedure of Example 1 was followed, except that the iron plating at 0.5 asi was for twenty minutes at 63° C. followed by a water rinse. The anodic treatment was carried out for four minutes. An adequate bond was attained.

EXAMPLE 3

The procedure of the previous example was followed, except that the iron plating was carried out at 8 asi for four minutes at 66° C. followed by a water rinse. The anodic treatment was carried out at 3 asi for 3 minutes at 60° C. An adequate bond was attained.

EXAMPLE 4

The procedure of the previous example was followed with the following exceptions:

A 1010 steel substrate was prepared as previous described and plated in a 485 g/l Copperas, 200 ml/l borax bath at 6 asi for 0.25 minutes and 1.5 asi for one minute. The plating bath temperature was 55° C. The anodic treatment employed a 150 g/l chromic acid bath at 2 asi for one minute at 57° C.

The chromic acid bath contained 700 g/l chromic acid, 2 g/l iodide and 4 g/l propionic acid and the treatment was at 4 asi for one hour at 60° C., yielding an adequate bond.

EXAMPLE 5

A 1020 steel substrate was prepared in accordance with the procedure of Example 1 and iron plated at 2 asi for one minute and 1 asi for 3 minutes at 69° C. followed by a water rinse.

The 150 g/l chromic acid anodic treatment bath was maintained at 56° C. The treatment was at 2 asi for three minutes.

The chromium plating employed a 400 g/l chromic acid, 120 g/l monochloroacetic acid, 1 g/l iodide bath at 4 asi for three quarters of an hour. The bath was maintained at 58° C. An adequate bond was produced.

EXAMPLE 6

The procedure of the previous example was followed except that the iron plating was at 2 asi for one minute and 1 asi for 5 minutes at 66° C. and the chromium plating bath was at 60° C. An adequate bond was produced.

EXAMPLE 7

The procedure of the previous example was followed, except that the iron plating was at 64° C., and the anodic treatment employed a 400 g/l chromic acid bath at 60° C. The treatment was at 8 asi for two minutes followed by the chromium plating at 4 asi for one hour at 60° C. The result was an adequate bond.

EXAMPLE 8

The procedure of Example 4 was followed, except that the F steel substrate was etched in the iron bath at 5 asi for one minute and the iron plating in the iron bath was at 5 asi for three minutes at 63° C. The chromic acid plating bath contained 700 g/l of chromic acid, 2 g/l iodide, and 8 g/l of the disodium salt of sulfoacetic acid ($Na_2SAA$). The plating was carried out at 4 asi for three quarters of an hour. The bath was maintained at 55° C. An adequate bond resulted from the process.

EXAMPLE 9

The procedure of the previous example was followed with the following modifications:

The substrate was a 4130 steel rod and the iron plating at 61° C. was carried out at 5 asi for 0.25 minutes and at 1.5 asi for one minute, followed by a water rinse. The anodic treatment bath contained 150 g/l chromic acid at 57° C. The treatment was at 2 asi for one minute. The chromium plating bath temperature was 60° C. and an adequate bond was produced.

EXAMPLE 10

An F steel drill rod was employed as the metal substrate. The iron containing electoplating bath contained 80 grams per liter of $FeSO_4.7H_2O$ and 100 milliliters per liter of sulfuric acid. The metal substrate was subjected to an anodic treatment for 30 seconds at 0.93 A/cm$^2$. Following the iron plating for 60 seconds at 0.93 A/cm$^2$, an anodic treatment in a 250 grams per liter $CrO_3$ bath was carried out for 60 seconds at 0.31 A/cm$^2$. The chromium plating bath was essentially 300 g/l $CrO_3$, 30 g/l $Na_2SAA$, 1.5 g/l I, 1.5 g/l $SO_4$. at 60° C. and required 15 minutes at 0.93 A/cm$^2$. The resultant chromium plating bond was adequate.

EXAMPLE 11

The conditions of Example 10 were employed, except that the iron plating bath additionally contained 10 g/l of $CoSO_4.7H_2O$. The plating produced adequate bond results.

EXAMPLE 12

The procedure of Example 10 was followed except that the plating bath additionally contained 20 g/l of $CoSO_4.7H_2O$. The plating produced adequate bond results.

Control 1

In place of the iron containing electroplating baths of Examples 13 and 14, a $CoSO_4.7H_2O$ (100 g/l) and sulfuric acid (80 ml/l) bath was employed for 60 seconds at 1.55 A/cm$^2$ to anodically treat the metal substrate followed by cathodic plating at the same conditions. The subsequent anodic treatment employed a 150 g/l chromic acid bath at 65° C. for 60 seconds at 0.46 A/cm$^2$. The chromium plating was carried out at 1.24 A/cm$^2$ for 15 minutes. Inadequate results were obtained.

Although the cobalt containing baths of Examples 11 and 12 produced no adverse results, the use of cobalt without iron in Controls 1 and 2 failed to yield adequate results.

Control 2

The conditions of Control 1 were employed except that the anodic, pre-iron plating, treatment was for 10 seconds and no anodic, pre-chromium plating, treatment was employed. The result was inadequate.

EXAMPLE 13

The procedure of Example 10 was essentially followed with several exceptions. The plating bath additionally contained 5 g/l $NiCO_3$, the $FeSO_4$ concentration was 100 g/l and the chromic acid concentration was 150 g/l in the pre-plate bath. The anodic treatment and the plating times and current densities were the same as employed in control 1. However, unlike the control runs, adequate adhesion was obtained.

EXAMPLES 14, 15 AND 16

The procedure of Example 13 was followed except that the $NiCO_3$ concentrations were, respectively, 10 g/l, 20 g/l and 40 g/l. Adequate adhesion was obtained in each case.

EXAMPLE 17

The procedure of Example 10 was followed, except that the iron containing bath was 485 g/l Copperas, 20 g/l borax and 200 ml/l of hydrochloric acid. The anodic treatment in the iron plating bath was for 60 seconds at 0.77 A/cm$^2$ The iron plating was for 15 seconds at 1.0 A/cm$^2$ and then for 60 seconds at 0.31 A/cm$^2$. The anodic treatment was for 60 seconds at 0.39 A/cm$^2$ in a bath containing 800 g/l of chromic acid. The chromium plating bath was essentially 300 g/l $CrO_3$, 30 g/l $Na_2SAA$, 1 g/l I and 1 g/l $SO_4$. The plating was for 15 minutes at 1.55 A/cm$^2$. An adequate bond was obtained.

EXAMPLE 18

Example 17 was followed, except that the substrate was VP steel. An adequate bond was obtained.

Control 3

The procedure of Example 17 was followed, except that the iron plating bath was replaced with a Wood's nickel bath having approximately 250 g/l of $NiCl_2.6H_2O$ and 125 ml/l of hydrochloric acid. The metal substrate was treated anodically in the Wood's bath for 30 seconds at 0.21 A/cm$^2$ to anodically treat the metal substrate followed by plating for 180 seconds at 0.21 A/cm$^2$. The next step was to anodically treat the plated metal substrate for 60 seconds at 0.39 A/cm$^2$. The chromium plating was for 15 minutes at 1.55 A/cm$^2$. No bond was obtained.

EXAMPLES 19, 20 AND 21

The procedure of Example 17 was followed, except that the anodic treatment in the iron plating bath was for 60 seconds at 0.08 A/cm$^2$. The iron plating was carried out for 120 seconds at 1.03 A/cm$^2$. The anodic treatment was for 60 seconds at 0.39 A/cm$^2$ followed by the chromium plating for 15 minutes at 1.55 A/cm$^2$. In Examples 20 and 21 the iron plating time was reduced to 60 and 30 seconds respectively. An adequate bond was obtained in each instance thus indicating that the time of plating in the iron-containing plating bath is not narrowly critical.

EXAMPLES 22 AND 23

The procedure of Example 10 was followed, except that the iron containing bath contained 100 g/l of Copperas and 100 ml/l of sulfuric acid and the substrates were F steel and 1010 steel in Examples 22 and 23, respectively. In each case the anodic treatment in the iron plating bath was for 60 seconds at 1.5 A/cm$^2$, and the iron plating was for 60 seconds at 1.5 A/cm$^2$. The anodic treatment was for 60 seconds at 0.37 A/cm$^2$ and the chromium plating for 15 minutes at 1.49 A/cm$^2$. An adequate bond was obtained in each case.

EXAMPLES 24 AND 25

The procedure of Example 22 was followed, except that the iron containing bath further included 50 g/l borax and the chromic acid containing solution in which the iron plated metal substrate was treated anodically, contained 150 g/l chromic acid. In example 24 no pre-iron plating treatment or iron plating was employed. In Example 25 the anodic treatment in the iron plating bath was for 60 seconds at 1.6 A/cm$^2$ and the iron plating was for 60 seconds at 1.6 A/cm$^2$. The pre-chromium plating anodic treatment was at 0.37 A/cm$^2$ for 120 seconds in Example 24 and for 60 seconds in Example 25. The chromium plating was for 15 minutes at 1.49 A/cm$^2$. An adequate bond was obtained in each case illustrating that the F steel does not necessarily require the treatments of the invention.

EXAMPLES 26, 27, 28 AND 29

The procedure of Examples 24 and 25 was essentially followed, except that the chromium plating bath was maintained at 34° C. in Examples 26 to 28 and at 45° C. in Example 29, and in that the chromium bath composition was 800 g/l $CrO_3$, 5 g/l I, and 10 g/l of Cl. In Example 26 the pre-iron plating, treatment step and the iron plating steps were omitted. In Example 27 the pre-chromium plating treatment step was omitted. In each case the anodic treatment in the iron plating bath was for 60 seconds at 1.55 A/cm$^2$, and the iron plating was for 60 seconds at 1.55 A/cm$^2$. The anodic treatment was at 0.35 A/cm$^2$ for 60 seconds. The chromium plating was for 15 minutes at 0.35 A/cm$^2$ in Example 26 and for 10 minutes in each of the other Examples. The current density was 0.77 A/cm$^2$ in Examples 27 and 28 and 0.62 in the other Example. An adequate bond was obtained in Example 29 but a very poor bond was obtained in Example 26 and a poor bond was obtained in the other two cases.

The influence of temperature on the chromium plating operation is discussed in copending patent application Ser. No. 295,430, filed Aug. 24, 1981, the subject matter of which is incorporated herein by reference in order to eliminate the need to include superfluous subject matter in the instant application.

The foregoing examples clearly show that successful chromium plating can be consistently achieved on iron or iron alloy substrates through the use of the procedures of the instant invention. The cause for a chromium plating to be unsuccessful on certain substrates is not readily apparent and sufficient information is not available on which to base a prediction as to the ability of metal substrates to support chromium plating without the use of the procedures of the invention. Chemical analysis of the substrates failed to reveal property differences or similarities on which a prediction could be based. The treatment of the present invention did not produce adverse effects but did provide consistent positive results.

The pre-iron plating treatment bath can be any of the commonly employed acid activating baths known to the art. For example, any bath of the type of pretreatment baths disclosed in Plating and Surface Finishing by Dini et al, November 1982, pages 63 to 65 and in Chromium Plating by Weiner et al, Finishing Publications Ltd., Teddington, England, 1980, at pages 102 through 104, can be used prior to the iron plating step.

In the case of the treatment prior to iron plating, the iron plating and the anodic treatment, the time, temperature and bath compositions are not narrowly critical. The time and current density must merely be sufficient to achieve the desired result as dictated by the nature of the particular substrate metal which is to be chromium plated.

What is claimed is:

1. A method of consistently forming an adherent chromium deposit on a metal substrate comprising the steps of:

(a) plating the substrate metal with iron or an iron alloy from an iron salt containing bath for a time and at a current density sufficient to produce an adherent iron or iron alloy plating on the substrate metal;

(b) depositing chromium on the iron or iron alloy plated metal substrate from a chromic acid bath containing a halogen releasing compound selected from the group consisting of iodine releasing compounds, bromine releasing compounds and mixtures thereof and chromic acid for a time and at a current density sufficient to produce an aherent chromium plating.

2. The method of claim 1, further comprising the step of subjecting the iron containing deposit on the substrate metal to an anodic treatment in a chromic acid containing bath prior to the step of depositing chromium on the plated metal substrate.

3. The method of claim 1 further comprising the step of subjecting the metal substrate to an activating treatment, prior to the step of plating the metal substrate with iron or an iron containing alloy.

4. The method of claim 2, wherein the metal substrate is an iron alloy and is subjected to a treatment in an acid containing bath prior to the step of plating the metal substrate with iron or an iron containing alloy.

5. The method of claim 4, wherein said acid of said acid containing bath is hydrochloric acid.

6. The method of claim 4, wherein said acid of said acid containing bath is sulfuric acid.

7. The method of claim 4, wherein said acid containing bath and said iron salt containing bath are essentially the same bath.

8. The method of claim 3, wherein said activating treatment is conducted in said chromic acid bath containing a halide.

9. The method of claim 3, wherein said activating treatment comprises electrolytic treatment of said metal substrate.

10. The method of claim 3, wherein said activating treatment comprises immersion treatment of said metal substrate.

11. The method of claim 1, wherein said metal substrate is iron or an iron containing alloy and further comprising the the step of subjecting the iron containing deposit on the substrate metal to an anodic treatment in a acid containing bath prior to the step of depositing chromium on the plated metal substrate.

* * * * *